US005248404A

United States Patent [19]

Semrau

[11] Patent Number: 5,248,404

[45] Date of Patent: Sep. 28, 1993

[54] ELECTRODEPOSITION JOINING METHOD AND EQUIPMENT

[76] Inventor: Wolfgang Semrau, Birkenwinkel 43, D-2904 Hatten, Fed. Rep. of Germany

[21] Appl. No.: 625,206

[22] Filed: Dec. 10, 1990

[30] Foreign Application Priority Data

Dec. 13, 1989 [DE] Fed. Rep. of Germany ..... 3941128

[51] Int. Cl.[5] ..... C25D 5/02

[52] U.S. Cl. ..... 205/114; 204/212; 204/224 R

[58] Field of Search ..... 204/16, 212, 224 R, 204/271; 205/114

[56] References Cited

U.S. PATENT DOCUMENTS

| | | | |
|---|---|---|---|
| 2,569,368 | 9/1951 | Bradner et al. | 204/16 |
| 3,671,406 | 6/1972 | Mattia et al. | 204/16 |
| 3,706,650 | 12/1972 | Eisner | 204/217 |
| 4,140,598 | 2/1979 | Kimoto et al. | 204/129.4 |

OTHER PUBLICATIONS

Metal Finishing Guidebook and Directory for 1975, Metals and Plastics Publications, Inc., Hackensack, N.J., pp. 394–402.

*Primary Examiner*—John Niebling
*Assistant Examiner*—William T. Leader

[57] ABSTRACT

The invention relates to an electrodeposition process for producing a metallic joint between two metal surfaces and equipment for performing this method, in which the electrolyte liquid is applied in the region of the joint on the surfaces to be joined (A,B) by a rotating, electrolytic coating device (1) having an integrated anode (4). This eliminates the necessity of immersing the structural parts in an electrolytic bath. It is possible to create a joint between two structural parts arranged at an acute angle to each other. The coating device is a roll (1), whose shape conforms to the geometry of the seam. The roll (1) is preferably composed of an elastic material.

7 Claims, 2 Drawing Sheets

ELECTRODEPOSITION JOINING METHOD AND EQUIPMENT

The invention pertains to an electrodeposition method for producing a metallic joint between two metal surfaces.

The electrolytic production of metallic joints between two metallic parts is already known. It is usually employed when the parts to be joined should not be subjected to thermal stress. This is the case, for example, in aircraft construction, in which riveted joints or adhesion techniques are slected as joining methods in order to avoid high thermal stresses. Electrodepostion joining methods art based on the principle of electrolytic deposition of metallic coatings in an electrolytic bath. Such a method is described in "85 Materials Engineering". pp. 42 and 43. This method has certain disadvantages. First, the structural parts to be joined must be completely immersed in the electrolytic bath, and second, joining is possible only between two surfaces oriented at a flat angle to each other. If the parts are to be joined are arranged at a sharp angle to each other, then, due to the unequal distances between cathode and anode, there is a nonuniform deposition of the deposited material at the cathode, i.e., at the surfaces to be joined.

The object of the invention was to further develop a generic method in such a way that a metallic joining could be produced between two metal surfaces arranged at any desired angle to each other, and that it would not be necessary to immerse the structural parts in the electrolytic bath. The invention also relates to equipment for performing the method.

In accordance with the invention, the electrolyte liquid is applied in the region of the joint on the surfaces to be joined by a rotating, electrolytic coating device with an integrated anode. This eliminates the necessity of immersing the structural parts in an electrolytic bath. By applying the electrolyte with a coating device, which is inserted directly at the point of contact between the structural parts to be joined, it is possible to join structural parts that are arranged at an acute angle to each other. The joint region can thus include practically any angle between 0° and 180° degrees. The rotational motion of the coating device causes mechanical removal of the oxide coatings on the structural parts. This increases the life of the joint.

The process of the invention can be used to produce a continuous seam. The surfaces are not joined at discrete points but rather continuously, even where the seam has a relatively complicated course. It is possible both to lay a "V" shaped seam with or without a root and to produce butt joints between structural parts.

Another advantage of the invention is that the seam strength can be determined by proper coordination of time and current intensity. If the contact pressure of the roll is suitably selected as a function of the time and current intensity, the process is able to follow the variable seam geometry as the deposited layer builds up; the process can thus be performed in an optimally economicaly way, since refinishing work becomes unnecessary.

An electrolytic thick coating system, such as a thick nickel plating or the like, is preferably used as the electrolyte, so that the metal application will not become too time consuming and the economy of the process will be improved. The use of electrolytes from which alloys are deposited is also conceivable for the purpose of improving the adaptation of the filler metal to the structural material.

The process of the invention makes it possible to join very complicated structural parts, such as honeycomb structures in aircraft construction or foam metals. For example, the joining of aluminum honeycomb structure with another structural part causes no difficulties.

In accordance with another advantageous modification of the process of the invention, the contact pressure of the coating device is selected in such a way that, when the coating device is made of abrasive materials, the contact pressure is greater at the beginning of the coating than in the subsequent course of the joining process for the sake of faster buildup of the deposition layer. This procedure is especially important for joining titanium and high-grade steels.

By advantageously designing the coating device as a roll adapted to the geometry of the seam and when composed of an elastic material, an optimal joint between the structural parts is achieved. The elastic material of the roll conforms to the seam root at the beginning of the joining process and to the seam geometry later in the joining process. Seam limitation can also be determined in advance by deformation of the roll, so that refinishing of the joint becomes unnecessary.

In accordance with another advantageous feature of the invention, namely, the use of abrasive materials as the roll material combined with a rotational motion of the roll, the surfaces to be joined are mechanically activated.

In accordance with an advantageous modification, the coating device has a sensor, preferably, a pressure sensor, in its axial bearing. The contact pressure of the roll can be regulated by comparing the actual contact pressure with the preset desired value.

The feature of providing the anode with an insulating cover in those places from which no current should flow makes it possible to achieve a geometrically controlled deposition while avoiding undesired flank buildup.

The attached drawings illustrate a specific embodiment of the invention.

Figure 1:
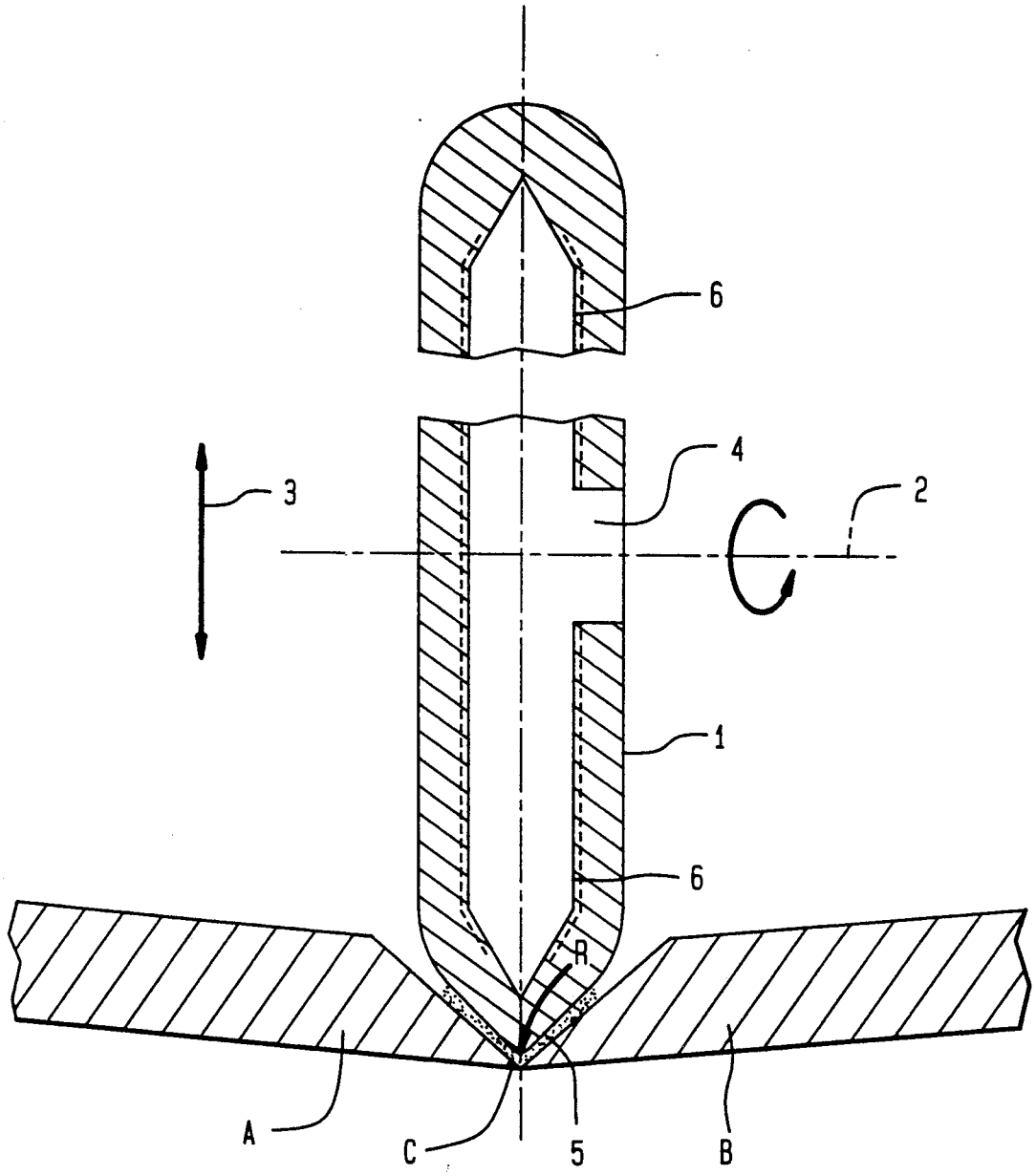
FIG. 1 is a schematic representation of the process at a point at the beginning of the joining process and during the joining process.
Figure 2:
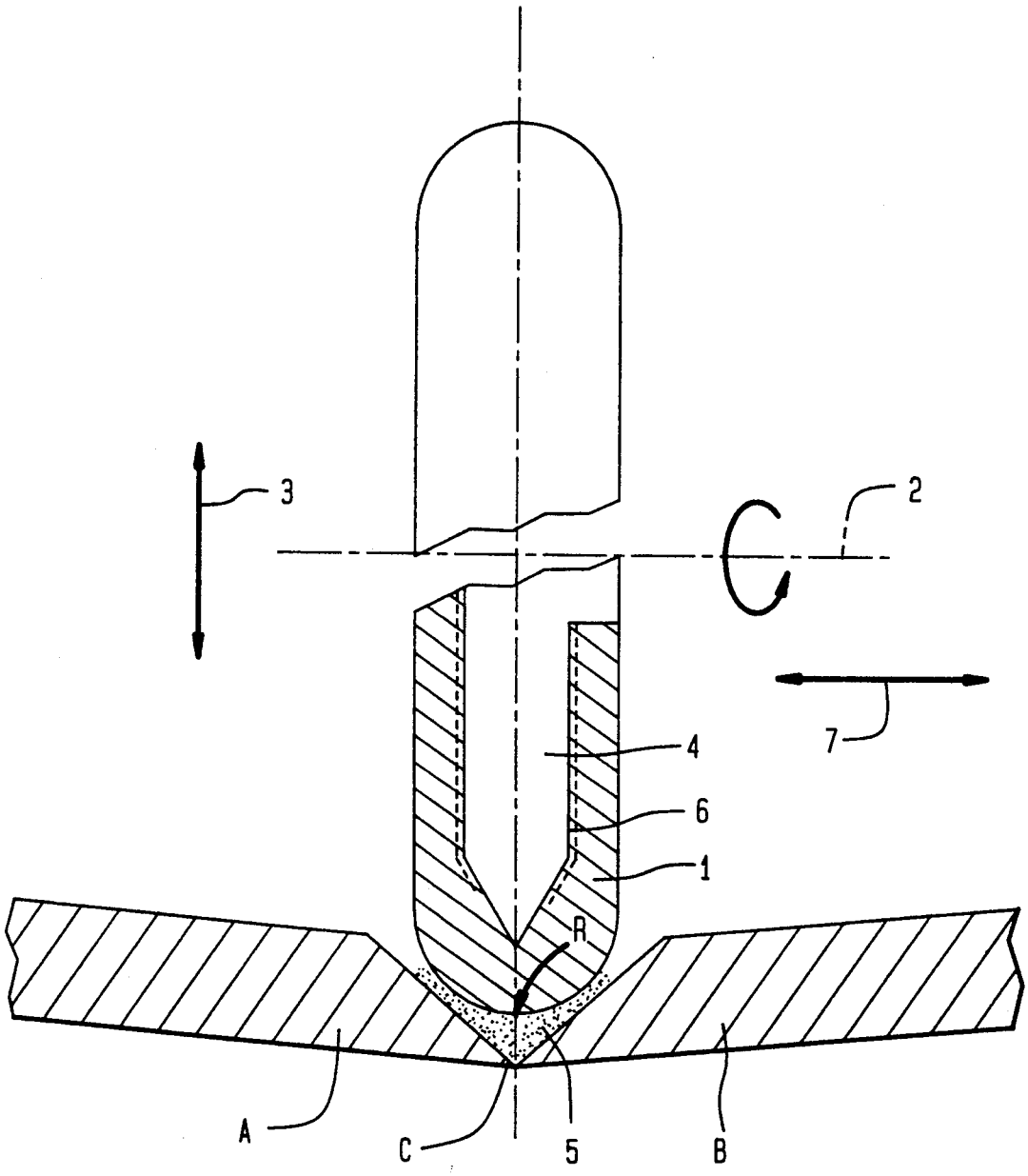
FIG. 2 is a schemtic representation of the process during the joining process.

The materials to be joined, (A and B) meet at point C at the beginning of the process. A roll 1 is placed in the region of the joint. The roll rotates about its axis 2, which at the same time is its axis of symmetry. The axis 2 can be moved in the direction of arrow 3. At the beginning of the joining process, the roll 1 has moved into the region of the joint near the contact point C of the two materials to be joined (A and B). The roll 1 is composed of an elastic material and contains an integrated anode 4. The anode 4 is covered with an insulator 6 in those areas from which no current should flow. When current is supplied to the anode, the deposition process begins. The deposited material initially collects in the immediate vicinity of point C (see FIG. 1). In the course of the process, the roll 1 is driven out of the region of the joint (see FIG. 2). In this stage of the process, the contact pressure is also lower than at the beginning of the joining process. In the partially built up seam 5 the elastic roll material of the roll 1 follows the seam geometry. As FIG. 2 illustrates, the radius R of the roll 1 increases in the course of the process. If the width of the growing seam 5 is greater than the width of the roll, the entire width of the seam can be uniformly built up by a rectilinear or swinging motion (arrow 7) of the roll 1 transverse to the seam 5.

I claim:

1. An electrodeposition process for producing a metallic joint between two metal surfaces which comprises the process steps of:

contacting the two metal surfaces with a rotating roll of an electrolytic coating apparatus wherein the rotating roll includes an integrated anode which has a central axis and an outer peripheral region and an elastic material covering at least the outer peripheral region and having a geometry adapted to contact the two metal surfaces and further adapted to supply an electrolyte liquid to the region of the two metal surfaces, and supplying an electric current to the anode so as to cause the formation of a deposit between the two metal surfaces to form a seam joining the two metal surfaces.

2. The process according to claim 1 wherein the rotating roll further includes a roll bearing and a pressure sensor.

3. The process according to claim 1 wherein the rotating roll further includes an insulator which covers a portion of the integrated anode of the rotating roll.

4. The process according to claim 1 wherein the elastic material of the rotating roll comprises abrasive materials.

5. The process according to claim 1 wherein the metallic joint between the two metal surfaces is a continuous seam or a discontinuous seam.

6. The process according to claim 1 wherein the deposit between the two metal surfaces is a metal deposit selected from the group of metals consisting of nickel, copper and bronze.

7. The process according to claim 1 wherein the initial contact pressure of the rotating roll is greater at the beginning of the coating process and decreases with increasing seam strength during the process.

* * * * *